US010395596B2

(12) United States Patent
Jang et al.

(10) Patent No.: US 10,395,596 B2
(45) Date of Patent: Aug. 27, 2019

(54) ORGANIC LIGHT EMITTING DISPLAY DEVICE, DATA DRIVER, AND METHOD FOR DRIVING DATA DRIVER

(71) Applicant: LG Display Co., Ltd., Seoul (KR)

(72) Inventors: SuHyuk Jang, Paju-si (KR); Hyojin Kim, Paju-si (KR); JaeWoo Lee, Paju-si (KR); HyeJin Kim, Goyang-si (KR); Jinwon Lee, Paju-si (KR); DaSol Jun, Incheon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/849,407

(22) Filed: Dec. 20, 2017

(65) Prior Publication Data

US 2018/0182298 A1 Jun. 28, 2018

(30) Foreign Application Priority Data

Dec. 28, 2016 (KR) ..... 10-2016-0180711

(51) Int. Cl.
*G09G 3/3258* (2016.01)
*G09G 3/3266* (2016.01)
(Continued)

(52) U.S. Cl.
CPC ..... *G09G 3/3258* (2013.01); *G09G 3/2014* (2013.01); *G09G 3/2077* (2013.01);
(Continued)

(58) Field of Classification Search
CPC .. G09G 3/3258; G09G 3/2014; G09G 3/2077; G09G 3/2081; G09G 3/3233;
(Continued)

(56) References Cited

U.S. PATENT DOCUMENTS 8,253,718 B2 8/2012 Tada et al.
2007/0008256 A1* 1/2007 Chiou ..... G09G 3/2014 345/82
(Continued)

FOREIGN PATENT DOCUMENTS

CN 103456275 A 12/2013
JP 2005-039490 A 2/2005
(Continued)

OTHER PUBLICATIONS

Taiwan First Office Action, Taiwan Application No. 106146213, dated Apr. 18, 2018, 5 pages.

*Primary Examiner* — Tom V Sheng
(74) *Attorney, Agent, or Firm* — Fenwick & West LLP

(57) ABSTRACT

An organic light emitting display device which improves expression capability in a low luminance level region, wherein, when receiving a pulse width modulation value indicating a low luminance level region, the device changes the received pulse width modulation value into a pulse width modulation dimming value indicating a high luminance level region, and expresses a low luminance level region through a luminance level indicated by the pulse width modulation dimming value and a pulse width modulation dimming operation. Luminance in a low luminance level region is controlled through a pulse width modulation dimming value indicating a high luminance level region and a pulse width modulation dimming operation, so that it is possible to minutely control luminance in a low luminance level region and improve expression capability in a low luminance level region.

34 Claims, 10 Drawing Sheets

(51) Int. Cl.
*G09G 3/20* (2006.01)
*G09G 3/3291* (2016.01)
*G09G 3/3233* (2016.01)

(52) U.S. Cl.
CPC ..... *G09G 3/3233* (2013.01); *G09G 3/3266* (2013.01); *G09G 3/3291* (2013.01); *G09G 2320/0238* (2013.01); *G09G 2320/0247* (2013.01); *G09G 2320/0271* (2013.01); *G09G 2320/0276* (2013.01); *G09G 2320/064* (2013.01); *G09G 2320/0673* (2013.01)

(58) Field of Classification Search
CPC ..... G09G 3/3266; G09G 3/3291; G09G 2320/0238; G09G 2320/0247; G09G 2320/0271; G09G 2320/0276; G09G 2320/064; G09G 2320/0673; G09G 2320/0626; G09G 2320/0633
See application file for complete search history.

(56) References Cited

U.S. PATENT DOCUMENTS

2007/0046596 A1* 3/2007 Sakakibara ..... G09G 3/002 345/87
2007/0115209 A1* 5/2007 Maejima ..... G09G 3/3406 345/46
2007/0126757 A1* 6/2007 Itoh ..... G09G 3/3233 345/690
2007/0229413 A1 10/2007 Hara
2008/0055196 A1* 3/2008 Izumida ..... G09G 3/32 345/46
2008/0062208 A1* 3/2008 Tada ..... G09G 3/2007 345/690
2008/0272996 A1* 11/2008 Wu ..... G09G 3/3406 345/87
2010/0123401 A1* 5/2010 Park ..... G09G 3/3426 315/153
2016/0028357 A1* 1/2016 Okada ..... H03G 1/02 381/333
2016/0155382 A1* 6/2016 Cheon ..... G09G 3/3233 345/690
2017/0215240 A1* 7/2017 Sawada ..... H05B 33/0815

FOREIGN PATENT DOCUMENTS

JP 2006-317534 A 11/2006
JP 2007-293264 A 11/2007
JP 2008-070496 A 3/2008
JP 2008-268503 A 11/2008
JP 2009-204802 A 9/2009
TW 200615892 A 5/2006
TW 201120864 A1 6/2011
TW 201227646 A1 7/2012

* cited by examiner

FIG.4

| PWM Dimming Enable | PWM Value (10bit) | | | | | | Selection Band (2bit) | Dimming Ratio | PWM Dimming Value | | | | | | Description |
|---|---|---|---|---|---|---|---|---|---|---|---|---|---|---|---|
| | 9 | 8 | 7 | 6 | ••• | 0 | | | 9 | 8 | 7 | 6 | ••• | 0 | |
| X | 1 | 1 | X | X | X | X | X | X | 1 | 1 | X | X | X | X | - PWM Dimming Value = PWM Value |
| X | 1 | 0 | X | X | X | X | X | X | 1 | 0 | X | X | X | X | |
| X | 0 | 1 | X | X | X | X | X | X | 1 | 0 | X | X | X | X | |
| 0 | 0 | 0 | X | X | X | X | X | X | 0 | 0 | X | X | X | X | - PWM Dimming Value = PWM Value |
| 1 | 0 | 0 | 1 | 1 | 1 | 1 | Selection Band3 (example : 2'b11) | Dimming Ratio 3 | 1 | 1 | 1 | 1 | 1 | 1 | - Range : 001<u>1</u>111111 ~ 001<u>1</u>000000<br>- PWM Dimming Value<br>= { Sel Band3, PWM Value [7:0]} |
| 1 | 0 | 0 | 1 | 1 | 0 | 0 | | | 1 | 1 | 1 | 1 | 0 | 0 | |
| 1 | 0 | 0 | 1 | 0 | 1 | 1 | Selection Band2 (example : 2'b10) | Dimming Ratio 2 | 1 | 0 | 1 | 0 | 1 | 1 | - Range : 001<u>0</u>111111 ~ 001<u>0</u>000000<br>- PWM Dimming Value<br>= { Sel Band2, PWM Value [7:0]} |
| 1 | 0 | 0 | 1 | 0 | 0 | 0 | | | 1 | 0 | 1 | 0 | 0 | 0 | |
| 1 | 0 | 0 | 0 | 1 | 1 | 1 | Selection Band1 (example : 2'b01) | Dimming Ratio 1 | 0 | 1 | 0 | 1 | 1 | 1 | - Range : 000<u>1</u>111111 ~ 000<u>1</u>000000<br>- PWM Dimming Value<br>= { Sel Band1, PWM Value [7:0]} |
| 1 | 0 | 0 | 0 | 1 | 0 | 0 | | | 0 | 1 | 0 | 1 | 0 | 0 | |
| 1 | 0 | 0 | 0 | 0 | 1 | 1 | Selection Band0 (example : 2'b00) | Dimming Ratio 0 | 0 | 0 | 0 | 0 | 1 | 1 | - Range : 000<u>0</u>111111 ~ 000<u>0</u>000000<br>- PWM Dimming Value<br>= { Sel Band0(Exclusive Band), PWM Value [7:0]} |
| 1 | 0 | 0 | 0 | 0 | 0 | 0 | | | 0 | 0 | 0 | 0 | 0 | 0 | |

FIG.5

| Luminance Out (10bit) | Luminance Out_PWM |
|---|---|
| 00_1111_1111 ~ 00_1100_0000 | 11_1111_1111 ~ 11_1100_0000 |
| 00_1011_1111 ~ 00_1100_0000 | 11_1011_1111 ~ 11_1100_0000 |
| 00_0111_1111 ~ 00_0100_0000 | 11_0111_1111 ~ 11_0100_0000 |
| 00_0011_1111 ~ 00_0000_0000 | 11_0011_1111 ~ 11_0000_0000 |

ORGANIC LIGHT EMITTING DISPLAY DEVICE, DATA DRIVER, AND METHOD FOR DRIVING DATA DRIVER

CROSS REFERENCE TO RELATED APPLICATIONS

This application claims priority from Republic of Korea Patent Application No. 10-2016-0180711, filed on Dec. 28, 2016, which is hereby incorporated by reference for all purposes as if fully set forth herein.

BACKGROUND

1. Field

The present embodiments relate to an organic light emitting display device, a data driver included in the organic light emitting display device, and a method for driving the data driver.

2. Description of the Prior Art

With the development of an information-oriented society, various demands for display devices for displaying images have increased, and various types of display devices, such as liquid crystal display devices, plasma display devices, and organic light emitting display devices have been used.

Among such display devices, the organic light emitting display device uses a self-luminous Organic Light Emitting Diode (OLED) and thereby has a fast response speed and is advantageous in contrast ratio, light emitting efficiency, luminance, viewing angle, and the like.

The organic light emitting display device includes an organic light emitting display panel in which a plurality of gate lines, a plurality of data lines, and a plurality of subpixels are arranged, a gate driver that drives the plurality of gate lines, a data driver that drives the plurality of data lines, a controller that controls driving of the gate driver and the data driver, and the like.

The organic light emitting display device applies data voltage to each of the subpixels in accordance with timing of a scan signal output by the gate driver to express gray scales according to the data voltage, so as to display an image.

The data driver that outputs the data voltage adjusts output luminance by controlling an analog gamma voltage according to luminance that is input as a digital value.

In case of calculating analog gamma voltage by using the input digital value, a boundary value in a low luminance level region is required for calculation of an output value with respect to a low luminance level.

A boundary value in such a low luminance level region should be configured to be larger than 0 nit, and is thus unable to express 0 nit. Moreover, it is difficult to adjust luminance in a low luminance level region having a value lower than the boundary value in the low luminance level region.

SUMMARY

An aspect of the present embodiments is to provide an organic light emitting display device which can precisely adjust luminance in a low luminance level region in a case of calculating analog gamma voltage by using a digital value, and a method for driving the organic light emitting display device.

An aspect of the present embodiments is to provide an organic light emitting display device which can minimize flicker generated in case of applying pulse width modulation dimming for output luminance adjustment and can minutely adjust output luminance, and a method for driving the organic light emitting display device.

An aspect of the present embodiments provides an organic light emitting display device including an organic light emitting display panel including a plurality of gate lines, a plurality of data lines, and a plurality of subpixels arranged therein, a gate driver that outputs a scan signal to the plurality of gate lines, a data driver that outputs data voltage to the plurality of data lines, and a controller that controls driving of the gate driver and the data driver.

The data driver of the organic light emitting display device may receive a pulse width modulation value, change the pulse width modulation value into a pulse width modulation dimming value indicating a luminance level higher than that indicated by the pulse width modulation value according to a pulse width modulation dimming enable signal, and output data voltage on the basis of the pulse width modulation value or the pulse width modulation dimming value.

The data driver may include a pulse width modulation control unit that receives a pulse width modulation value, a selection band signal, and a pulse width modulation dimming enable signal and generates a pulse width modulation dimming value by using the pulse width modulation value and the selection band signal according to the pulse width modulation dimming enable signal. The data driver may also include a luminance control unit that outputs the pulse width modulation value or the pulse width modulation dimming value according to the pulse width modulation dimming enable signal. The data driver may also include a gamma voltage control unit that outputs gamma voltage on the basis of a luminance level indicated by a value that is output by the luminance control unit.

The pulse width modulation control unit of the data driver may output an identical value to the pulse width modulation value as the pulse width modulation dimming value when the pulse width modulation dimming enable signal has a value of "0", and may output a pulse width modulation dimming value including the selection band signal as an upper bit when the pulse width modulation dimming enable signal has a value of "1".

The selection band signal may indicate one of a plurality of bands including luminance level regions discriminable from each other, and one band including a luminance level region overlapping at least a part of the luminance level regions included in the plurality of bands.

When a pulse width modulation dimming value indicating a luminance level higher than that indicated by the pulse width modulation value is output, the gate driver of the organic light emitting display device may output a plurality of scan signals which turn off a subpixel within one image frame interval.

At this time, the gate driver may output the scan signals such that at least one gap among gaps between the scan signals output within the one image frame interval is different from the other gaps.

The controller of the organic light emitting display device may output, within a blank interval of the one image frame interval, an internal data enable signal output within an interval in which an input data enable signal is output.

Another aspect of the present embodiments provides an organic light emitting display device including an organic light emitting display panel including a plurality of gate lines, a plurality of data lines, and a plurality of subpixels arranged therein; a gate driver that outputs a scan signal to the plurality of gate lines. The organic light emitting display device may also include a data driver that outputs data voltage to the plurality of data lines, wherein the data driver outputs a first analog gamma voltage belonging to a first gamma voltage region, in accordance with a first digital luminance value belonging to a first luminance level region, and outputs a second analog gamma voltage belonging to a first gamma voltage region, in accordance with a second digital luminance value belonging to a second luminance level region different from the first luminance level region.

Another aspect of the present embodiments provides a data driver including a pulse width modulation control unit that receives a pulse width modulation value, a selection band signal, and a pulse width modulation dimming enable signal, changes the pulse width modulation value into a pulse width modulation dimming value indicating a luminance level higher than that indicated by the pulse width modulation value according to the pulse width modulation dimming enable signal, and outputs the pulse width modulation value and the pulse width modulation dimming value. The data driver may also include a luminance control unit that outputs the pulse width modulation value or the pulse width modulation dimming value according to the pulse width modulation dimming enable signal. The data driver may also include a gamma voltage control unit that outputs gamma voltage on the basis of a luminance level indicated by a value output by the luminance control unit.

The data driver may be operated in a process including the steps of receiving a pulse width modulation value, generating a pulse width modulation dimming value indicating a luminance level higher than that indicated by the pulse width modulation value, on the basis of a pulse width modulation dimming enable signal and a selection band signal, and outputting data voltage on the basis of the pulse width modulation value or the pulse width modulation dimming value according to the pulse width modulation dimming enable signal.

According to the present embodiments, output luminance in a low luminance level region is adjusted by using a digital value indicating a high luminance level region and pulse width modulation dimming operation, so that it is possible to minutely adjust luminance in the low luminance level region.

In addition, a low luminance level region is expressed by using a band including a high luminance level region, so that it is possible to reduce the number of bands required for calculation of output luminance.

In addition, during a pulse width modulation dimming operation, two or more times of high speed dimming in one image frame is employed to minimize the influence of flicker caused by the pulse width modulation dimming operation.

Embodiments also relate to a display device including a display panel, a data driver, and a gate driver. The display panel includes a plurality of gate lines, a plurality of data lines, and a plurality of pixels arranged at intersections of the plurality of gate lines and the plurality of data lines. The data driver drives the plurality of data lines and is configured to receive image data for a first frame and a first pulse width modulation (PWM) value. The first PWM value indicates a first mapping between a set of grayscale values and a first set of luminance values. The data driver is configured to convert the first PWM value to a PWM dimming value greater than the first PWM value responsive to a determination to modify the first PWM value. The PWM dimming value indicates a second mapping between the set of grayscale values and a second set of luminance values. The data driver is configured to identify, for a pixel of the display device having a grayscale value for the first frame corresponding to a first luminance value in the first mapping, a second luminance value from the second mapping corresponding to the grayscale value of the pixel. The second luminance value is higher than the first luminance value. The data driver is configured to apply, during an image display interval of the first frame, a gamma voltage corresponding to the second luminance value to a data line electrically connected to the pixel. The gate driver drives the plurality of gate lines, and is configured to adjust a duty cycle of the pixel during the image display interval of the first frame such that a luminance level of the pixel is lower than the second luminance value.

Embodiments also relate to a method for driving a display device. Image data for a first frame and a first pulse width modulation (PWM) value is received from a controller. The first PWM value indicates a first mapping between a set of grayscale values and a first set of luminance values. Responsive to a determination to modify the first PWM value, the first PWM value is converted to a PWM dimming value greater than the first PWM value. The PWM dimming value indicates a second mapping between the set of grayscale values and a second set of luminance values. A second luminance value from the second mapping is identified for a pixel of the display device. The pixel has a grayscale value for the first frame corresponding to a first luminance value in the first mapping. The second luminance value is higher than the first luminance value. A gamma voltage corresponding to the second luminance value is applied during an image display interval of the first frame. A duty cycle of the pixel is adjusted during the image display interval of the first frame such that a luminance level of the pixel is lower than the second luminance value.

BRIEF DESCRIPTION OF THE DRAWINGS

The above and other objects, features and advantages of the present disclosure will be more apparent from the following detailed description taken in conjunction with the accompanying drawings, in which:

FIG. 4 is a view illustrating an example of a pulse width modulation dimming value output by a data driver in an organic light emitting display device according to an embodiment of the present disclosure.

FIG. 5 is a view illustrating an example of a digital value which is output to control luminance by a data driver in an organic light emitting display device according to an embodiment of the present disclosure.

DETAILED DESCRIPTION OF THE EXEMPLARY EMBODIMENTS

Figure 1:
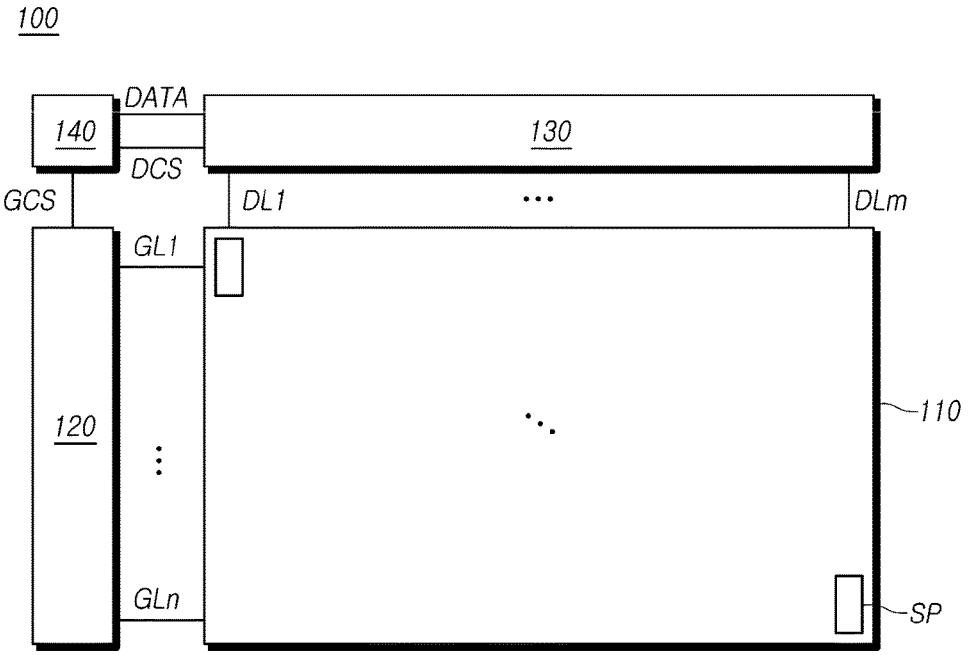
FIG. 1 is a view illustrating an organic light emitting display device according to an embodiment of the present disclosure.

Hereinafter, some embodiments of the present disclosure will be described in detail with reference to the accompanying illustrative drawings. In designating elements of the drawings by reference numerals, the same elements will be designated by the same reference numerals although they are shown in different drawings. Further, in the following description of the present disclosure, a detailed description of known functions and configurations incorporated herein will be omitted when it may make the subject matter of the present disclosure rather unclear.

In addition, terms, such as first, second, A, B, (a), (b) or the like may be used herein when describing components of the present disclosure. These terms are merely used to distinguish one component from other components, and the property, order, sequence, number and the like of the corresponding component are not limited by the corresponding term. In the case that it is described that a certain structural element "is connected to", "is coupled to", or "is in contact with" another structural element, it should be interpreted that another structural element may "be interposed between" respective certain structural elements or the respective certain structural elements may "be connected", "be coupled", or "be in contact" through another structural element as well as that the certain structural element is directly connected to or is in direct contact with another structural element.

FIG. 1 briefly illustrates a configuration of an organic light emitting display device 100 according to an embodiment of the present disclosure.

Referring to FIG. 1, an organic light emitting display device 100 according to an embodiment of the present disclosure includes an organic light emitting display panel 110 including a plurality of gate lines GL, a plurality of data lines DL, and a plurality of subpixels arranged therein, a gate driver 120 that drives the plurality of gate lines GL, a data driver 130 that drives the plurality of data lines DL, a controller 140 that controls the gate driver 120 and the data driver 130, and the like.

The gate driver 120 sequentially supplies scan signals to the plurality of gate lines GL, to sequentially drive the plurality of gate lines GL.

The gate driver 120 sequentially supplies scan signals of ON voltage or OFF voltage to the plurality of gate line GL according to control of the controller 140, to sequentially drive the plurality of gate lines GL.

According to driving methods, the gate driver 120 may be disposed at only one side of the organic light emitting display panel 110, or may be disposed at both sides thereof.

In addition, the gate driver 120 may include one or more gate driver intergrated circuits.

Each of the gate driver integrated circuits may be connected to a bonding pad of the organic light emitting display panel 110 by a Tape Automated Bonding (TAB) method or a Chip On Glass (COG) method, or may be implemented by a Gate In Panel (GIP) type to be directly disposed on the organic light emitting display panel 110.

In addition, each of the gate driver integrated circuits may be integrated and be disposed on the organic light emitting display panel 110, or may be implemented by a Chip On Film (COF) method in which each of the gate driver integrated circuits is mounted on a film connected to the organic light emitting display panel 110.

The data driver 130 drives the plurality of data lines DL by supplying data voltage to the plurality of data lines DL.

The data driver 130 converts image data received from the controller 140 into an analog type of data voltage when a predetermined gate line GL is turned on, and supplies the data voltage to the plurality of data lines DL to drive the plurality of data lines DL.

The data driver 130 may include at least one source driver integrated circuit to drive the plurality of data lines DL.

Each source driver integrated circuit may be connected to a bonding pad of the organic light emitting display panel 110 by a Tape Automated Bonding (TAB) method or a Chip On Glass (COG) method, may be directly disposed on the organic light emitting display panel 110, or may be integrated and be disposed on the organic light emitting display panel 110.

In addition, each source driver integrated circuit may be implemented by a Chip On Film (COF) method. In this case, each source driver integrated circuit has one end bonded to at least one source printed circuit board, and the other end bonded to the organic light emitting display panel 110.

The controller 140 supplies various control signals to the gate driver 120 and the data driver 130 to control the gate driver 120 and the data driver 130.

The controller 140 starts a scan according to timing implemented in each frame, converts input image data received from the outside according to a data signal format used in the data driver 130, outputs the converted image data, and controls data driving according to proper timing based on the scan.

The controller 140 receives various timing signals including a vertical synchronization signal (Vsync), a horizontal synchronization signal (Hsync), an input Data Enable (DE) signal, a clock signal (CLK), and the like as well as the input image data from the outside (for example, a host system).

The controller 140 not only converts input image data received from the outside according to a data signal format used in the data driver 130 and outputs the converted image data, but also receives timing signals including a vertical synchronization signal (Vsync), a horizontal synchronization signal (Hsync), an input Data Enable (DE) signal, a clock signal (CLK), and the like to generate various control signals and output the control signals to the gate driver 120 and the data driver 130, in order to control the gate driver 120 and the data driver 130.

For example, in order to control the gate driver 120, the controller 140 outputs various Gate Control Signals (GCSs) including a Gate Start Pulse (GSP), a Gate Shift Clock (GSC), a Gate Output Enable (GOE) signal, and the like.

The Gate Start Pulse (GSP) controls operation start timings of one or more gate driver integrated circuits included in the gate driver 120. The Gate Shift Clock (GSC) corresponds to a clock signal commonly input to one or more gate driver integrated circuits, and controls shift timing of a scan signal (gate pulse). The Gate Ouput Enable (GOE) signal designates timing information of one or more gate driver integrated circuits.

Further, in order to control the data driver 130, the controller 140 outputs various Data Control Signals (DCSs)

including a Source Start Pulse (SSP), a Source Sampling Clock (SSC), a Source Output Enable (SOE) signal, and the like.

The Source Start Pulse (SSP) controls data sampling start timings of one or more source driver integrated circuits included in the data driver 130. The Source Sampling Clock (SSC) corresponds to a clock signal that controls data sampling timing in each of the source driver integrated circuits. The Source Output Enable (SOE) signal controls output timing of the data driver 130.

The controller 140 may be disposed on a control printed circuit board (not illustrated) connected through a connecting medium, such as a Flexible Flat Cable (FFC) and a Flexible Printed Circuit (FPC), to a source printed circuit board to which a source driver integrated circuit is bonded.

The control printed circuit board may further include a power controller (not illustrated) disposed therein, which supplies various voltages or currents to the organic light emitting display panel 110, the gate driver 120, the data driver 130, and the like, or controls various voltages or currents to be supplied. The power controller is referred to as a power management Integrated Circuit (Power Management IC).

In the organic light emitting display device 100, the data driver 130 receives a digital value to adjust luminance of an image displayed through the organic light emitting display panel 110, and calculates the received digital value to output an analog gamma voltage.

In order to calculate a digital value, a boundary value of each luminance level region is required, and thus causes a difficulty of luminance adjustment in a low luminance level region having a value lower than a boundary value of a low luminance level region.

The organic light emitting display device 100 according to the present embodiments controls output luminance in a low luminance level region by using a pulse width modulation dimming operation method and a digital value with respect to a high luminance level region, thereby improving expression capability in a low luminance level region and minutely adjusting luminance.

Figure 2:
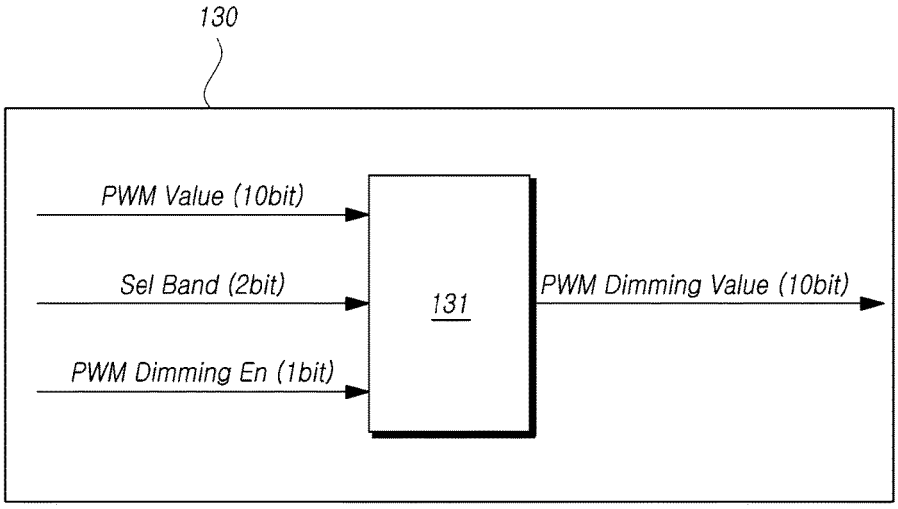
FIG. 2 is a view illustrating a data driver in an organic light emitting display device according to an embodiment of the present disclosure.

FIG. 2 illustrates a configuration of a data driver 130 in an organic light emitting display device 100 according to an embodiment of the present disclosure.

Referring to FIG. 2, a data driver 130 of an organic light emitting display device 100 according to an embodiment includes a pulse width modulation control unit 131 that receives a pulse width modulation value from the outside, a selection band signal, and a pulse width modulation dimming enable signal, and outputs a pulse width modulation dimming value on the basis of the received signal.

The pulse width modulation control unit 131 receives a pulse width modulation value corresponding to a digital value indicating an output luminance level from the outside, wherein the pulse width modulation value may be configured by 10 bits, for example. The pulse width modulation value may be represented by a first number (e.g., 10) of bits.

The pulse width modulation value is configured by 10 bits and indicates one luminance level of the entire luminance level regions. The pulse width modulation value may indicate a first mapping between a set of grayscale values (e.g., 0-255) and a first set of luminance values.

When receiving a pulse width modulation value indicating a low luminance level region, the pulse width modulation control unit 131 receives a selection band signal and a pulse width modulation dimming enable signal which are required for changing the received pulse width modulation value.

The selection band signal is a signal indicating a luminance level region to be used during outputting in a low luminance level region, and when a luminance level region is discriminable into four bands, a selection band signal may be configured by two bits and may indicate one band among the four bands. In other words, the selection band signal may indicate a range of pulse width modulation values. The selection band signal may be represented by a second number (e.g., 2) of bits. The second number of bits of the selection band signal may be smaller than the first number of bits of the pulse width modulation value.

The four bands may include three bands discriminable from each other within the remaining luminance level region except for the low luminance level region, and one band having a luminance level region overlapping at least a part of the discriminable three bands.

That is, in order to adjust output luminance within a low luminance level region, a band for the remaining luminance level region except for the low luminance level region is basically used. Further, being supplemented with this band, a separate exclusive band for controlling output luminance within the low luminance level region may be additionally used.

The pulse width modulation dimming enable signal is a signal for indicating whether pulse width modulation dimming is applied when a gamma voltage having a luminance level indicated by the pulse width modulation value is output, and may be configured by 1 bit, for example.

For example, the pulse width modulation control unit 131 does not change the pulse width modulation value when a pulse width modulation dimming enable signal has a value of "0", and outputs the received pulse width modulation value as a pulse width modulation dimming value, without change.

For example, when a pulse width modulation value is a digital value indicating a luminance level region except for a low luminance level region, output luminance is controlled according to the received pulse width modulation value without applying pulse width modulation dimming.

Meanwhile, the pulse width modulation control unit 131 changes two bits among upper bits of the pulse width modulation value into a value of a selection band signal when a pulse width modulation dimming enable signal has a value of "1", to generate a pulse width modulation dimming value.

That is, when a pulse width modulation value indicates a low luminance level region, the pulse width modulation control unit 131 includes a selection band signal as an upper bit of the pulse width modulation value, thereby changing the pulse width modulation value indicating the low luminance level region into a pulse width modulation dimming value indicating a luminance level region except for the low luminance level region. In other words, the pulse width modulation value may be converted to the pulse width modulation dimming value by replacing the second number of the most-significant bits of the pulse width modulation value with the second number of bits of the selection band signal.

Therefore, when receiving a pulse width modulation value indicating a low luminance level region, the pulse width modulation control unit 131 changes the pulse width modulation value into a pulse width modulation dimming value indicating a high luminance level region, and allows a low luminance level region to be expressed by using output luminance of a high luminance level region through a pulse width modulation dimming operation. The pulse width modulation dimming value may indicate a second mapping between the set of grayscale values and a second set of luminance values that are different from the first mapping.

In other words, a data driver 130 of an organic light emitting display device 100 according to the present embodiments outputs a first analog gamma voltage belonging to a first gamma voltage region, in accordance with a first digital luminance value belonging to a first luminance level region, and outputs a second analog gamma voltage belonging to the first gamma voltage region, in accordance with a second digital luminance value belonging to a second luminance level region different from the first luminance level region.

Further, a second pulse width modulation duty cycle different from a first pulse width modulation duty cycle applied to the first analog gamma voltage is applied to the second analog gamma voltage, so that luminance corresponding to the second digital luminance value may be expressed by using the second analog gamma voltage belonging to the first gamma voltage region. The on time of pixels during the second pulse width modulation duty cycle may be smaller than the on time of pixels during the first pulse width modulation duty cycle. In other words, when a pixel of the display device has a first luminance value from the first mapping, and a second luminance value from the second mapping that corresponds to a grayscale value of the pixel in image data for a first frame, the second luminance value may be higher than the first luminance value. The data driver 130 applies a gamma voltage to the pixel corresponding to the second luminance value. The duty cycle of the pixel during an image display interval of the first frame is adjusted such that the output luminance level of the pixel is lower than the second luminance value. The duty cycle may be adjusted by repeatedly turning on and off the pixel such that an on time of the pixel is reduced. The duty cycle may be adjusted based on the selection band signal. For example, the duty cycle may be lower for a selection band signal corresponding to a range of higher pulse width modulation values than for a selection band signal corresponding to a range of lower pulse width modulation values.

This configuration allows output luminance to be minutely adjusted within a low luminance level region and can improve expression capability in a low luminance level region.

Figure 3:
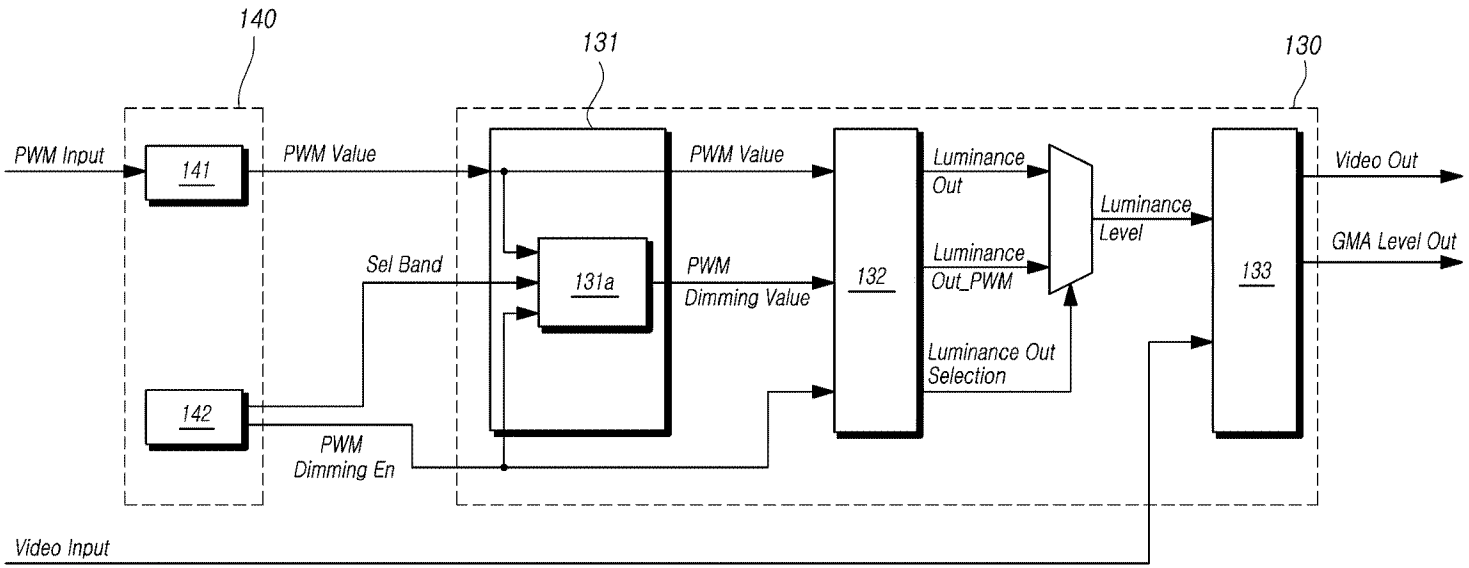
FIG. 3 is a view specifically illustrating a configuration of a data driver in an organic light emitting display device according to an embodiment of the present disclosure.

FIG. 3 illustrates a configuration of a data driver 130 according to an embodiment of the present disclosure, which has been described in reference with FIG. 2.

Referring to FIG. 3, a data driver 130 according to the present embodiments may include a pulse width modulation control unit 131, a luminance control unit 132, and a gamma voltage control unit 133. Further, the pulse width modulation control unit 131 may include a pulse width modulation dimming calculation unit 131*a*.

The pulse width modulation control unit 131 of the data driver 130 receives a pulse width modulation value according to an input of a pulse width modulation received from the outside by a pulse width modulation reception unit 141 of the controller 140.

Further, the pulse width modulation control unit 131 receives a selection band signal and a pulse width modulation dimming enable signal from a parameter storage unit 142 of the controller 140.

The pulse width modulation dimming calculation unit 131*a* of the pulse width modulation control unit 131 generates a pulse width modulation dimming value by using the pulse width modulation value and the selection band signal according to the received pulse width modulation dimming enable signal.

For example, the pulse width modulation dimming calculation unit 131*a* may not change the pulse width modulation value when the pulse width modulation dimming enable signal has a value of "0", and may output the pulse width modulation value as a pulse width modulation dimming value, without change.

Further, the pulse width modulation dimming calculation unit 131*a* may change an upper bit of the pulse width modulation value into a selection band signal when the pulse width modulation dimming enable signal has a value of "1", to generate a pulse width modulation dimming value.

Since the pulse width modulation dimming calculation unit 131*a* changes an upper bit indicating a band of a luminance level region in a pulse width modulation value into a selection band signal, a pulse width modulation value may be changed into a pulse width modulation dimming value indicating a luminance level region different from that indicated by the pulse width modulation value.

For example, when a pulse width modulation value is a digital value indicating a low luminance level region and a selection band signal is a value indicating a band of a high luminance level region, the pulse width modulation dimming calculation unit 131*a* changes an upper bit of the pulse width modulation value into a selection band signal, so as to change the pulse width modulation value into a pulse width modulation dimming value indicating a high luminance level region.

The selection band signal may be a signal indicating one band among bands of a luminance level region except for the low luminance level region, and may be a signal indicating a separate exclusive band configured for a pulse width modulation dimming operation of the low luminance level region.

The separate exclusive band may indicate a luminance level region discriminable from a luminance level region except for the low luminance level region, and may be configured to include a luminance level region overlapping at least a part of the remaining luminance level region.

The pulse width modulation dimming calculation unit 131*a* outputs a pulse width modulation dimming value changed according to a pulse width modulation dimming enable signal.

The luminance control unit 132 receives the pulse width modulation value and the pulse width modulation dimming value from the pulse width modulation dimming control unit 131, and outputs a signal indicating a luminance level according to the received pulse width modulation value or pulse width modulation dimming value.

The luminance control unit 132 outputs luminance corresponding to the pulse width modulation value and pulse width modulation luminance corresponding to the pulse width modulation dimming value. Further, the luminance control unit 132 determines a luminance level to be output according to the pulse width modulation dimming enable signal received from the parameter storage unit 142 of the controller 140.

For example, the luminance control unit 132 outputs a luminance level corresponding to the pulse width modulation value when the pulse width modulation dimming enable signal has a value of "0", and outputs a luminance level corresponding to the pulse width modulation dimming value when the pulse width modulation dimming enable signal has a value of "1".

The gamma voltage control unit 133 outputs a gamma voltage according to a luminance level that is output by the luminance control unit 132.

Therefore, the data driver 130 according to the present embodiments changes a pulse width modulation value into a pulse width modulation dimming value and applies a pulse width modulation dimming operation, and thereby allows a low luminance level region to be expressed by using a digital value indicating a high luminance level region.

This configuration allows output luminance to be minutely adjusted in a low luminance level region, and thus can improve expression capability in a low luminance level region.

FIG. 4 illustrates an example in which a pulse width modulation control unit 131 changes a pulse width modulation value into a pulse width modulation dimming value according to a pulse width modulation dimming enable signal and a selection band signal, in a data driver 130 according to the present embodiments.

Referring to FIG. 4, the pulse width modulation control unit 131 of the data driver 130 does not change the pulse width modulation value when the pulse width modulation dimming enable signal is not input or is input as a value of "0", and outputs the pulse width modulation value as the pulse width modulation dimming value, without change.

For example, when receiving a pulse width modulation value of a high luminance level region, the pulse width modulation control unit 131 outputs the received pulse width modulation value as it is, so as to control luminance of a gamma voltage that is output at luminance corresponding to the high luminance level region.

When receiving a value of "1" as a pulse width modulation dimming enable signal, the pulse width modulation control unit 131 changes the pulse width modulation value into a pulse width modulation dimming value by using a selection band signal.

As illustrated in FIG. 4, when a pulse width modulation dimming enable signal has a value of "1", the two upper bits of a pulse width modulation signal are used as a selection band signal, so as to output a pulse width modulation dimming value.

For example, when a selection band signal has a value of "11", the two upper bits of the pulse width modulation signal are changed into "11", so as to output the changed pulse width modulation signal.

The selection band signal may indicate four bands, and "11", "10", and "01" may sequentially indicate bands of a high luminance level region. Further, the selection band signal "00" may indicate an exclusive band separately configured for a pulse width modulation dimming operation of a low luminance level region.

Therefore, the pulse width modulation control unit 131 changes a pulse width modulation value of a low luminance level region into a pulse width modulation dimming value indicating a high luminance level region, according to a selection band signal, and then outputs the pulse width modulation dimming value.

And then, the pulse width modulation control unit 131 outputs a gamma voltage according to luminance corresponding to the output pulse width modulation dimming value, and allows a low luminance level region to be expressed through a pulse width modulation dimming operation.

FIG. 5 illustrates an example of a digital value that is output to control luminance by a luminance control unit 132, in a data driver 130 according to the present embodiments.

Referring to FIG. 5, when a digital value indicating luminance corresponding to a pulse width modulation value is output, the two upper bits of the digital value have a value of "00".

Further, a digital value indicating luminance corresponding to a pulse width modulation dimming value which has been changed by using a selection band signal is output in a state where the two upper bits of the digital value have been changed into a value of "11".

The value of "11" may correspond to a selection band signal which indicates the highest luminance level region, and the two upper bits of a digital value indicating luminance corresponding to a pulse width modulation dimming value according to a selection band signal may be "10", "01", and the like.

The luminance control unit 132 of the data driver 130 outputs a luminance level corresponding to a pulse width modulation value or a luminance level corresponding to a pulse width modulation dimming value, according to a pulse width modulation dimming enable signal, so that the gamma voltage control unit 133 may output a gamma voltage on the basis of the luminance level.

Figure 6:
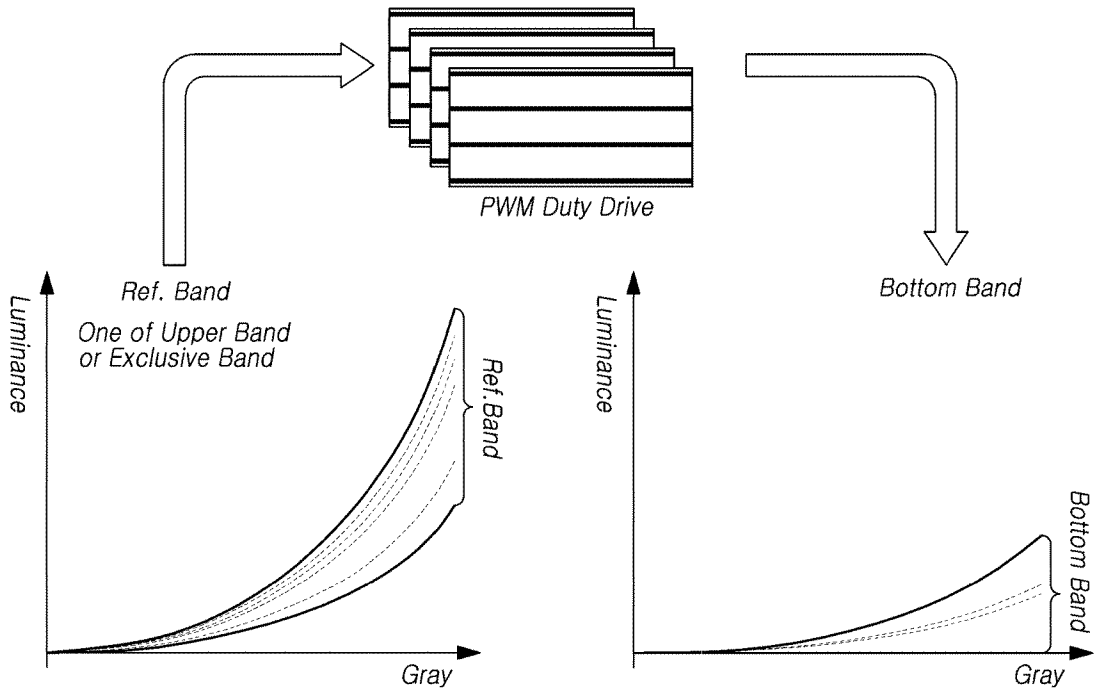
FIGS. 6 to 8 are views illustrating methods for expressing, by a data driver, a low luminance level region by using a pulse width modulation dimming operation and a digital value of a high luminance level region in an organic light emitting display device according to embodiments of the present disclosure.
Figure 7:
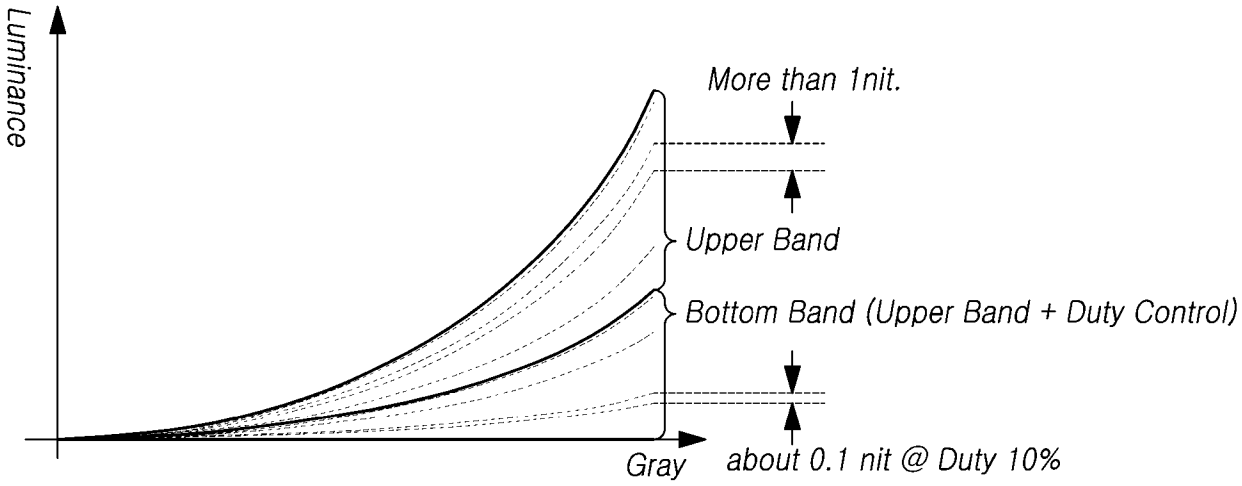
Figure 8:
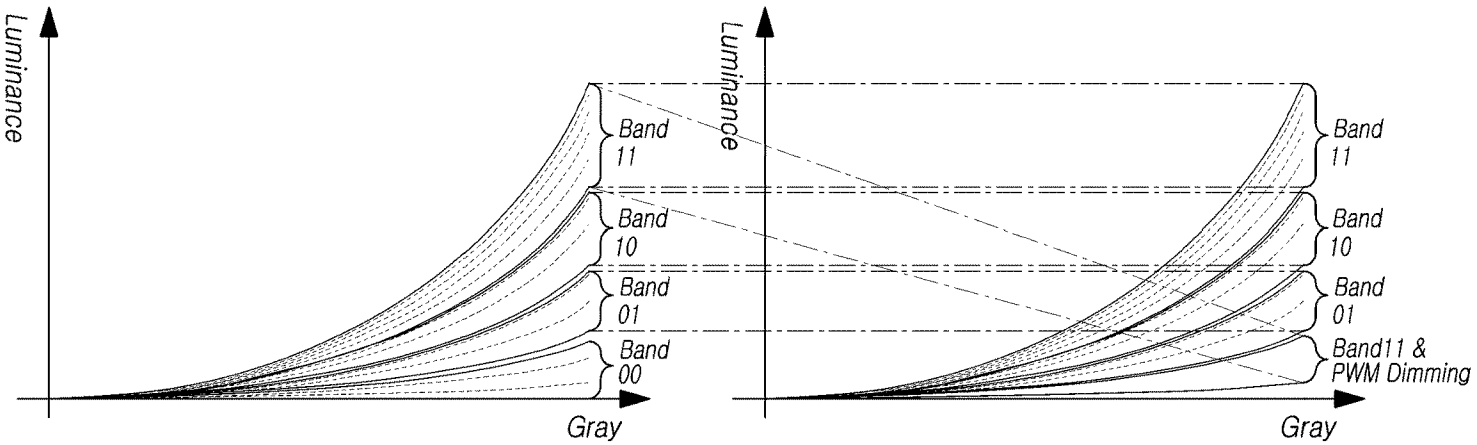

FIGS. 6 to 8 illustrates a method in which a data driver 130 according to the present embodiments applies a digital value indicating a high luminance level region and a pulse width modulation dimming operation to adjust output luminance of a low luminance level region.

Referring to FIG. 6, a data driver 130 selects one band among bands including a high luminance level region in order to express luminance of a low luminance level region.

The selected band may be one of a plurality of bands including a luminance level region except for the low luminance level region, and may be a separate exclusive band configured for a pulse width modulation dimming operation of the low luminance level region.

The data driver 130 calculates an analog gamma voltage by using a digital value indicating a luminance level included in the selected band, and allows a low luminance level region to be expressed through a pulse width modulation dimming operation by using a digital value of a high luminance level region.

That is, in order to express a low luminance level region, the data driver 130 uses a digital value of a high luminance level region, without using a digital value of the low luminance level region, and allows the low luminance level region to be expressed through a pulse width modulation dimming operation.

Accordingly, it is possible to not only minutely adjust luminance in a low luminance level region, but also express a luminance level which could not be expressed due to a boundary value of the low luminance level region.

FIG. 7 illustrates an example in which output luminance in a low luminance level region is minutely adjusted through a digital value of a high luminance level region and a pulse width modulation dimming operation.

Referring to FIG. 7, when output luminance is controlled by using a digital value of a high luminance level region, luminance with respect to every adjacent digital values may be adjusted at one nit.

Meanwhile, in order to control output luminance in a low luminance level region, a pulse width modulation dimming operation is applied to a digital value of a high luminance level region, and therefore, it is possible to minutely adjust luminance through duty adjusting during the pulse width modulation dimming operation.

For example, in a high luminance level region, the luminance can be adjusted at an interval of one nit through adjacent digital values. However, in a low luminance level region, the duty during a pulse width modulation dimming operation is adjusted to 10%, so that luminance can be adjusted at an interval of 0.1 nit.

Therefore, it is possible to minutely adjust luminance in a low luminance level region, so that expression capability can be improved in the low luminance level region.

FIG. 8 illustrates an example of expressing a low luminance level region through a pulse width modulation dimming operation when the number of luminance level regions indicated by a selection band signal is four.

Referring to FIG. 8, each band may be designated by a selection band signal which corresponds to two bits since the number of bands in a luminance level region is configured to be four.

When being "11", "10", and "01", the selection band signal indicates a band for a high luminance level region, and when being "00", the selection band signal may indicate a separate exclusive band configured for a pulse width modulation dimming operation of a low luminance level region.

FIG. 8 illustrates an example where the selection band signal "00" indicates a band discriminable from a band of a high luminance level region. However, a selection band signal may indicate a band including a luminance level region overlapping a part of the high luminance level region.

When receiving a pulse width modulation value of a low luminance level region, the data driver 130 changes the pulse width modulation value into a pulse width modulation dimming value indicating a high luminance level region according to a pulse width modulation dimming enable signal and a selection band signal.

Further, the data driver 130 controls luminance through a pulse width modulation dimming operation, and thereby allows a low luminance level region to be expressed by using a pulse width modulation dimming value indicating a high luminance level region.

That is, as illustrated in FIG. 8, a low luminance level region is expressed through a band of a high luminance level region, indicated by the selection band signal "11", and a pulse width modulation dimming operation.

In addition, according to a selection band signal, a low luminance level region may be expressed by using a luminance level region indicated by the selection band signal "10" or "01" or a luminance level region indicated by the selection band signal "00".

Therefore, according to the present embodiments, when a pulse width modulation value indicating a high luminance level region is input, a pulse width modulation dimming operation is not performed, and luminance is controlled according to the pulse width modulation value.

Further, when a pulse width modulation value indicating a low luminance level region is input, the pulse width modulation value is changed into a pulse width modulation dimming value and the low luminance level region is expressed through a pulse width modulation dimming operation.

Accordingly, it is possible to minutely control luminance in a low luminance level region, and improve expression capability in a low luminance level region.

Figure 9:
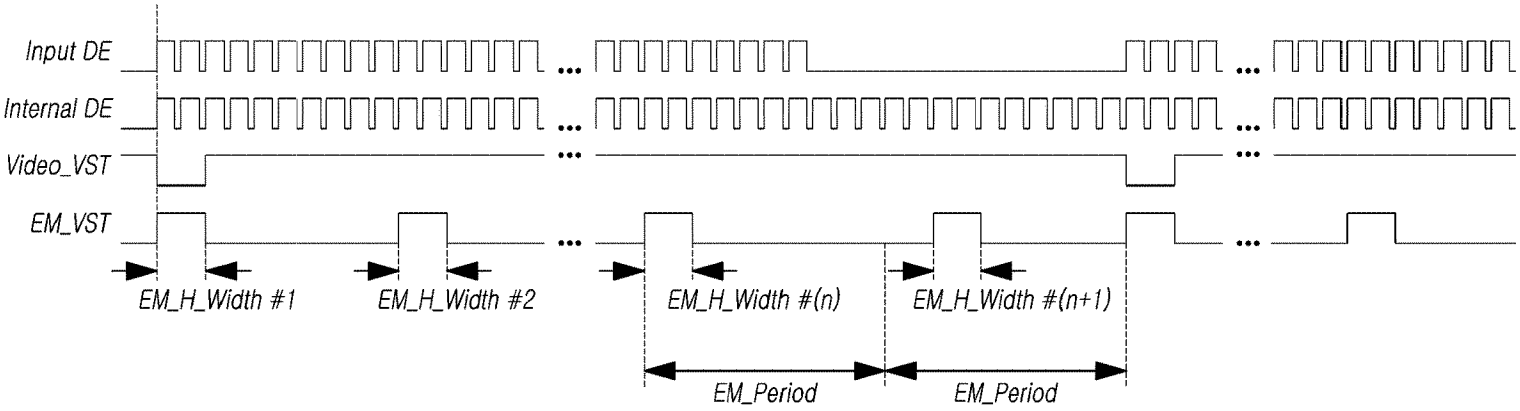
FIG. 9 is a view illustrating an example of timing of a signal output for a pulse width modulation dimming operation in an organic light emitting display device according to an embodiment of the present disclosure.

FIG. 9 illustrates an example of timing of a signal which is output during a pulse width modulation dimming operation in an organic light emitting display device 100 according to the present embodiments.

Referring to FIG. 9, a controller 140 of an organic light emitting display device 100 according to the present embodiments receives an input data enable signal DE from the outside, and outputs an internal data enable signal in accordance with timing of the input data enable signal DE.

The controller 140 duplicates an internal data enable signal which is output in an activation interval of one image frame and outputs the duplicated signal in a blank interval of the one image frame.

As described above, an internal data enable signal is output in a blank interval of one image frame, so that it is possible to prevent an imbalance of OFF times from occurring in the blank interval during a pulse width modulation dimming operation. Thus, pixels may be repeatedly turned on and off during the black interval of the one image frame.

The gate driver 120 performs a pulse width modulation dimming operation by outputting a scan signal (for example, an EM signal) that turns off a subpixel operated by each gate line GL. Thus, the duty cycles of pixels may be adjusted during an image display interval of the one image frame by repeatedly turning on and off the pixels during the image display interval.

For example, the gate driver 120 may output a plurality of scan signals within one image frame interval. Further, when an image frame is operated at 60 Hz, the gate driver 120 may output a scan signal four times to allow a 240 Hz pulse width modulation dimming operation.

A plurality of scan signals are output within one image frame, so as to employ high speed dimming, and thus it is possible to minimize the influence of flicker during a pulse width modulation dimming operation. Thus, the gate driver 120 is configured to adjust the duty cycle of the pixels during the pulse width modulation dimming operation to repeatedly turn on and off the pixels.

In this regard, intervals at which a plurality of scan signals that turn off a subpixel are output are randomly adjusted, so as to prevent block-dim effects which may occur at a fixed position.

Through the pulse width modulation dimming operation, a low luminance level region can be expressed by using a pulse width modulation dimming value indicating a high luminance level region.

Figure 10:
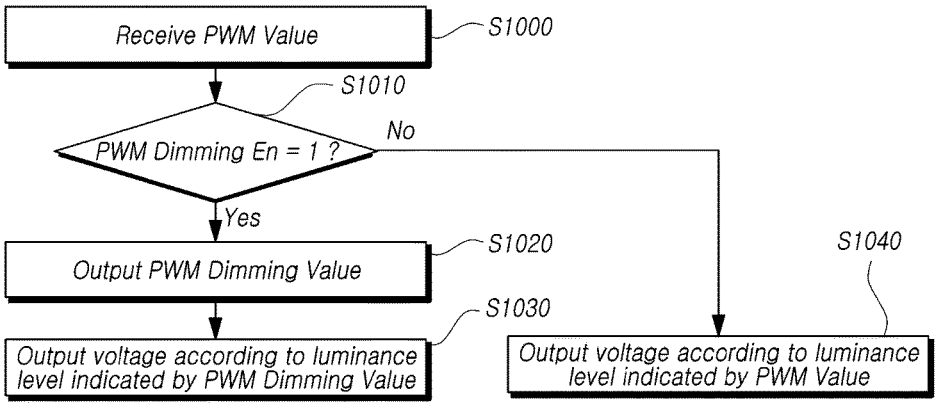
FIG. 10 is a view illustrating a process of a method for driving a data driver according to an embodiment of the present disclosure.

FIG. 10 illustrates a process of a method for driving a data driver 130 according to the present embodiments.

Referring to FIG. 10, a data driver 130 according to the present embodiments receives a pulse width modulation value from the outside, in step S1000. The data driver 130 may also receive image data for a first frame along with the pulse width modulation value. The pulse width modulation value may indicate a first mapping between a set of grayscale values and a first set of luminance values. The pulse width modulation value may be represented by a first number of bits.

And then, the data driver 130 identifies a pulse width modulation dimming enable signal, in step S1010, and when the pulse width modulation dimming enable signal has a value of "1", the data driver 130 changes an upper bit of the pulse width modulation value into a selection band signal to output a pulse width modulation dimming value, in step S1020. The selection band signal may be represented as a second number of bits. The pulse width modulation dimming value may be generated by replacing the second number of most-significant bits of the pulse width modulation value with the second number of bits of the selection band signal. The pulse width modulation dimming value may indicate a second mapping between the set of grayscale values and a second set of luminance values. A luminance value in the second set corresponding to a grayscale value may be higher than a luminance value in the first set corresponding to the same grayscale value.

The data driver 130 outputs gamma voltage according to a luminance level indicated by the pulse width modulation dimming value having been changed from the pulse width modulation value, in step S1030, and allows luminance lower than a luminance level indicated by the pulse width modulation dimming value to be expressed through a pulse width modulation dimming operation.

When the pulse width modulation dimming enable signal has a value of "0", the data driver 130 outputs gamma voltage according to a luminance level indicated by the pulse width modulation value, in step S1040, and expresses the luminance level indicated by the pulse width modulation value.

Therefore, according to the present embodiments, when a pulse width modulation value corresponds to a digital value indicating a high luminance level region, a pulse width modulation dimming operation is not performed, and luminance is controlled according to the pulse width modulation value.

Further, when a pulse width modulation value corresponds to a digital value indicating a low luminance level region, the pulse width modulation value is changed into a pulse width modulation dimming value indicating a high luminance level region and a low luminance level region may be expressed through a pulse width modulation dimming operation.

Accordingly, it is possible to minutely control luminance of a low luminance level region, and improve expression capability in a low luminance level region.

In addition, a scan signal that is output to turn off a subpixel operated by a gate line GL during a pulse width modulation dimming operation is output multiple times, so that it is possible to minimize flicker which may occur during the pulse width modulation dimming operation. Further, intervals of outputting scan signals are random, so that it is possible to prevent block-dim effects from occurring at a fixed position.

Although a preferred embodiment of the present invention has been described for illustrative purposes, those skilled in the art will appreciate that various modifications, additions and substitutions are possible, without departing from the scope and spirit of the invention as disclosed in the accompanying claims. Accordingly, the embodiments disclosed in the present invention are only for describing, but not limiting, the technical idea of the present invention, and the scope of the technical idea of the present invention is not limited by the embodiments. The scope of the present invention shall be construed on the basis of the accompanying claims in such a manner that all of the technical ideas included within the scope equivalent to the claims belong to the present invention.

What is claimed is:

1. An organic light emitting display device comprising:

an organic light emitting display panel including a plurality of gate lines, a plurality of data lines, and a plurality of subpixels arranged therein;

a gate driver configured to output scan signals to the plurality of gate lines;

a data driver configured to output data voltages to the plurality of data lines; and a controller configured to control driving of the gate driver and the data driver, wherein the data driver is configured to receive a pulse width modulation value, change the pulse width modulation value into a pulse width modulation dimming value indicating a luminance level higher than that indicated by the pulse width modulation value according to a pulse width modulation dimming enable signal, and output gamma voltages on the basis of the pulse width modulation value or the pulse width modulation dimming value according to the pulse width modulation dimming enable signal.

2. The organic light emitting display device of claim 1, wherein the data driver comprises:

a pulse width modulation control unit configured to receive the pulse width modulation value, a selection band signal, and the pulse width modulation dimming enable signal, and generate the pulse width modulation dimming value by using the pulse width modulation value and the selection band signal according to the pulse width modulation dimming enable signal;

a luminance control unit configured to output the pulse width modulation value or the pulse width modulation dimming value according to the pulse width modulation dimming enable signal; and a gamma voltage control unit configured to output gamma voltages on the basis of the pulse width modulation value or the pulse width modulation dimming value output by the luminance control unit.

3. The organic light emitting display device of claim 2, wherein the pulse width modulation control unit is configured to output an identical value to the pulse width modulation value as the pulse width modulation dimming value when the pulse width modulation dimming enable signal has a value of "0".

4. The organic light emitting display device of claim 2, wherein the pulse width modulation control unit is configured to output the pulse width modulation dimming value including the selection band signal as upper bits when the pulse width modulation dimming enable signal has a value of "1".

5. The organic light emitting display device of claim 2, wherein the selection band signal is configured to indicate one of a plurality of bands including luminance level regions discriminable from each other, and one band including a luminance level region overlapping at least a part of the luminance level regions included in the plurality of bands.

6. The organic light emitting display device of claim 1, wherein, when the pulse width modulation dimming value indicating a luminance level higher than that indicated by the pulse width modulation value is output, the gate driver is configured to output the scan signals which turn off a subpixel within one image frame interval.

7. The organic light emitting display device of claim 6, wherein the gate driver is configured to output the scan signals such that at least one gap among gaps between the scan signals output within the one image frame interval is different from the remaining gaps.

8. The organic light emitting display device of claim 1, wherein the controller is configured to output, within a blank interval of one image frame interval, an internal data enable signal output within an interval in which an input data enable signal is output, wherein the controller receives the input data enable signal from outside and outputs the internal data enable signal in accordance with timing of the input data enable signal, and wherein the controller outputs the internal data enable signal within the blank interval of one image frame to prevent an imbalance of OFF times from occurring in the blank interval during a pulse width modulation dimming operation.

9. A data driver comprising:

a pulse width modulation control unit configured to receive a pulse width modulation value, a selection band signal, and a pulse width modulation dimming enable signal, change the pulse width modulation value into a pulse width modulation dimming value indicating a luminance level higher than that indicated by the pulse width modulation value according to the pulse width modulation dimming enable signal, and output the pulse width modulation value and the pulse width modulation dimming value;

a luminance control unit configured to output the pulse width modulation value or the pulse width modulation dimming value according to the pulse width modulation dimming enable signal; and a gamma voltage control unit configured to output gamma voltage on the basis of a luminance level indicated by a value output by the luminance control unit.

10. The data driver of claim 9, wherein the pulse width modulation control unit is configured to output an identical value to the pulse width modulation value as the pulse width modulation dimming value when the pulse width modulation dimming enable signal has a value of "0".

11. The data driver of claim 9, wherein the pulse width modulation control unit is configured to output a pulse width modulation dimming value including the selection band signal as upper bits when the pulse width modulation dimming enable signal has a value of "1".

12. The data driver of claim 9, wherein the selection band signal is configured to indicate one of a plurality of bands including luminance level regions discriminable from each other, and one band including a luminance level region overlapping at least a part of the luminance level regions included in the plurality of bands.

13. A method for driving a data driver, comprising:

receiving a pulse width modulation value;

generating a pulse width modulation dimming value indicating a luminance level higher than that indicated by the pulse width modulation value on the basis of a pulse width modulation dimming enable signal and a selection band signal; and outputting data voltage on the basis of the pulse width modulation value or the pulse width modulation dimming value according to the pulse width modulation dimming enable signal.

14. The method of claim 13, wherein the generating of the pulse width modulation dimming value comprises generating the pulse width modulation dimming value as an identical value to the pulse width modulation value when the pulse width modulation dimming enable signal has a value of "0".

15. The method of claim 13, wherein the generating of the pulse width modulation dimming value comprises changing upper bits of the pulse width modulation value to the selection band signal when the pulse width modulation dimming enable signal has a value of "1".

16. The method of claim 13, wherein the selection band signal is configured to indicate one of a plurality of bands including luminance level regions discriminable from each other, and one band including a luminance level region overlapping at least a part of the luminance level regions included in the plurality of bands.

17. An organic light emitting display device comprising:

an organic light emitting display panel including a plurality of gate lines, a plurality of data lines, and a plurality of subpixels arranged therein;

a gate driver configured to output scan signals to the plurality of gate lines; and a data driver configured to output data voltages to the plurality of data lines, wherein the data driver is configured to output a first analog gamma voltage belonging to a first gamma voltage region in accordance with a first digital luminance value belonging to a first luminance level region, and output a second analog gamma voltage belonging to the first gamma voltage region in accordance with a second digital luminance value belonging to a second luminance level region different from the first luminance level region.

18. The organic light emitting display device of claim 17, wherein the second luminance level region has a luminance level lower than a luminance level of the first luminance level region.

19. The organic light emitting display device of claim 17, wherein the gate driver is configured to apply to the second analog gamma voltage, a second pulse width modulation duty cycle different from a first pulse width modulation duty cycle which is applied to the first analog gamma voltage.

20. The organic light emitting display device of claim 19, wherein the organic light emitting display panel is configured to display luminance corresponding to the second digital luminance value through the second analog gamma voltage to which the second pulse width modulation duty cycle is applied.

21. A display device, comprising:

a display panel including a plurality of gate lines, a plurality of data lines, and a plurality of pixels arranged at intersections of the plurality of gate lines and the plurality of data lines;

a data driver for driving the plurality of data lines, the data driver configured to:

receive image data for a first frame and a first pulse width modulation (PWM) value, wherein the first PWM value indicates a first mapping between a set of grayscale values and a first set of luminance values;

responsive to a determination to modify the first PWM value, convert the first PWM value to a PWM dimming value greater than the first PWM value, the PWM dimming value indicating a second mapping between the set of grayscale values and a second set of luminance values, identify, for a pixel of the display device having a grayscale value for the first frame corresponding to a first luminance value in the first mapping, a second luminance value from the second mapping corresponding to the grayscale value, wherein the second luminance value is higher than the first luminance value, and apply, during an image display interval of the first frame, a gamma voltage corresponding to the second luminance value to a data line electrically connected to the pixel; and a gate driver for driving the plurality of gate lines, the gate driver configured to adjust a duty cycle of the pixel during the image display interval of the first frame such that luminance of the pixel is lower than the second luminance value.

22. The display device of claim 21, wherein the data driver is further configured to receive a selection band signal indicating a first range of PWM values including the PWM dimming value.

23. The display device of claim 22, wherein the first PWM value is represented by a first number of bits and the selection band signal is represented by a second number of bits, the second number smaller than the first number.

24. The display device of claim 23, wherein the data driver is further configured to convert the first PWM value to the PWM dimming value by replacing the second number of most-significant bits of the first PWM value with the second number of bits of the selection band signal.

25. The display device of claim 22, wherein the gate driver adjusts the duty cycle of the pixel based on the selection band signal.

26. The display device of claim 21, wherein the gate driver adjusts the duty cycle of the pixel by repeatedly turning on and off the pixel during the image display interval of the first frame for a predetermined number of times.

27. The display device of claim 26, wherein the gate driver is configured to repeatedly turn on and off the pixel during a blank interval of the first frame.

28. A method for driving a display device, comprising:

receiving image data for a first frame and a first pulse width modulation (PWM) value from a controller, the first PWM value indicating a first mapping between a set of grayscale values and a first set of luminance values;

responsive to a determination to modify the first PWM value, converting the first PWM value to a PWM dimming value greater than the first PWM value, the PWM dimming value indicating a second mapping between the set of grayscale values and a second set of luminance values;

identifying, for a pixel of the display device having a grayscale value for the first frame corresponding to a first luminance value in the first mapping, a second luminance value from the second mapping corresponding to the grayscale value, wherein the second luminance value is higher than the first luminance value;

applying, during an image display interval of the first frame, a gamma voltage to the pixel corresponding to the second luminance value; and adjusting a duty cycle of the pixel during the image display interval of the first frame such that luminance of the pixel is lower than the second luminance value.

29. The method of claim 28, further comprising:

receiving a selection band signal indicating a first range of PWM values including the PWM dimming value.

30. The method of claim 29, wherein the first PWM value is represented by a first number of bits and the selection band signal is represented by a second number of bits, the second number smaller than the first number.

31. The method of claim 30, wherein converting the first PWM value to the PWM dimming value comprises replacing the second number of most-significant bits of the first PWM value with the second number of bits of the selection band signal.

32. The method of claim 29, wherein the duty cycle is adjusted based on the selection band signal.

33. The method of claim 28, wherein adjusting the duty cycle of the pixel comprises repeatedly turning on and off the pixel during the image display interval of the first frame for a predetermined number of times.

34. The method of claim 33, further comprising repeatedly turning on and off the pixel during a blank interval of the first frame.

* * * * *